United States Patent [19]

Strandli

[11] 4,140,059

[45] Feb. 20, 1979

[54] SAFETY DEVICE FOR PROJECTILES

[75] Inventor: Kåare R. Strandli, Raufoss, Norway

[73] Assignee: A/S Raufoss Ammunisjonsfabrikker, Norway

[21] Appl. No.: 810,188

[22] Filed: Jun. 27, 1977

[30] Foreign Application Priority Data

Jul. 1, 1976 [NO] Norway ..... 762298

[51] Int. Cl.[2] ..... F42B 13/02

[52] U.S. Cl. ..... 102/57; 102/DIG. 9

[58] Field of Search ..... 102/57, 58, DIG. 9

[56] References Cited

U.S. PATENT DOCUMENTS

| | | | |
|---|---|---|---|
| 2,269,475 | 1/1942 | Pomeroy | 102/57 |
| 2,402,552 | 6/1946 | Hopkins | 102/57 |
| 2,866,414 | 12/1958 | Smith | 102/57 |
| 3,599,570 | 8/1969 | Ingersoll et al. | 102/57 |

*Primary Examiner*—Charles T. Jordan

*Attorney, Agent, or Firm*—Larson, Taylor & Hinds

[57] ABSTRACT

A safety device for a projectile is provided which includes a charge adapted to function as either an ignition charge or as a booster and relay charge. The charge comprises at least two components each of which comprises solid particles. These solid particles are disposed in the same cavity in the projectile and are entirely or partly separated. The particles forming the components are arranged in relation to each other such that the two components will be mixed subsequent to the firing of the projectile, responsive to the acceleration, rotation and retardation forces to which the particles are subjected after the projectile is fired. The two components comprise an oxygen donating component and a fuel component, and a third component for promoting mixing of the two may also be included.

7 Claims, 3 Drawing Figures

SAFETY DEVICE FOR PROJECTILES

The present invention relates to a safety device for projectiles comprising a charge which has for its object to act as an ignition charge or as a booster and relay charge.

The invention has for its object to provide such a safety device which has substantial advantages over, known such devices and thus constitutes a technical contribution within this field.

The conventional method for arranging an ignition charge in a projectile is to provide a pyrotechnical batch consisting of a mixture of a fuel component and an oxygen donating component. The production of such a batch consists in mixing said components in desired proportion, whereupon the ready mixed batch is poured into the nose hood of the projectile and thereafter is pressed in place by means of a piston. The ignition charge will be ignited when the nose hood is subjected to a sufficiently strong and rapid compression as caused by, for example, hitting a target after being fired.

The ignition charge can, however, also be ignited by excessive forces due to falling of the projectile. This constitutes a lack of safety which of course cannot be accepted. An acceptable ignition charge must not be sensitive when subjected to such falls and shocks which can occur by operative use. Thus an ignition charge of this type is restricted to use only for relatively light types of ammunition or ammunition which is not subjected to severe fall or shock load. The sensitivity of ignition after firing of the projectile against a target is not satisfactory satisfying if this sensitivity because of safety reasons is too small. It is known that by use of the same pyrotechnical components in a charge, the sensitivity of the charge can be adjusted by using different ratios between the fuel and oxygen components. Separately these components are very sensitive. When a conventional ignition charge is made the proportions of the components must be determined beforehand as a compromise between shock sensitivity and sensitivity after being fired.

According to the present invention the ignition charge components are not mixed before the actual firing of the projectile, meaning that the oxygen donating component and the fuel component are kept entirely or partly separated until this time. After firing of the projectile the two components are mixed together by means of the forces to which these components are subjected, so that when the projectile impinges a target the components constitute a fully effective ignition charge. By this arrangement a number of safety and functional advantages are obtained. For example, the ignition charge is not sensitive during transport and storing, it is relatively insensitive immediately after firing and its sensitiveness increases as the projectile exits from the gun.

As a booster and relay charge the charge of the invention has the advantage that it cannot be ignited by a detonator or other ignition device before the projectile has left the gun.

The invention thus results in substantial safety and functional advantages as seen in relation to previous known pyrotechnical incendiary charges which have been used as ignition means or as booster and relay charges in projectiles. Norwegian Pat. No. 121.934 discloses such a prior art ignition charge.

For further explanation of the invention reference should be had to the discussion below with reference to some embodiments of the invention illustrated in the accompanying drawings.

Figure 1:
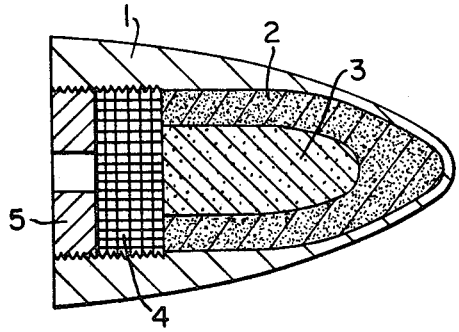
FIG. 1 is a cross sectional view of a first embodiment of the invention.

FIG. 1 shows an example of a projectile comprising the invention. Reference numeral 1 denotes a nose or nose hood in the foremost part of which is pressed in an oxygen donating component 2 provided with a central bore or a cavity. This cavity is filled with fuel 3 which is arranged more or less loosely in the cavity. The nose hood 1 is also supplied with a commonly mixed batch 4, that is a premixed batch having a predetermined relation between the oxygen donating component and the fuel. The entire charge in the nose hood is supported by a disc 5. In the example described the charge is very insensitive to falls and shock which can occur during storing and transport, the charges 2 and 3 in the nose of the projectile, taken separately, being very insensitive. Thus the entire nose hood must be totally crushed to provide possible ignition. When the projectile is fired it will be subject to great acceleration forces in the firing phase. These forces will far exceed those forces binding the oxygen donating particles together. The fuel particles which are arranged loosely or almost loosely in the cavity will give no support for the oxygen donating component, which particles are firmly pressed together. This results in a complete breaking up of the oxygen donating particles. The situation immediately after firing will therefore be that the charge 2, 3 located before the premixed charge 4 consists of a loose particle mass having most of the oxygen donating particles located outermost.

When the acceleration forces cease the dominating forces acting in the projectile will be rotational forces and to a smaller degree, retardation forces.

The batch particles in the foremost part of the nose hood will therefore, due to rotation, be mixed together at the same time as the cavity formed at the foremost end of the hood is little by little filled up due to the retardation forces.

After a certain ballistic distance the two components 2 and 3 will have mixed sufficiently to provide a sensitiveness such as to cause ignition even by impinging even a thin metal plate.

As will be understood according to the invention an arrangement is provided whereby great safety advantages are obtained if the projectile is subject to falling or shock against the projectile nose during transport or storage. Further it is provided that the ignition charge is not very sensitive immediately after being fired which also affords great safety. If the projectile hits branches or bushes in the near surroundings of the gun, as may occur during operative conditions, the projectile will not have a tendency to be ignited, which again means less risk to the personnel serving in the gun range.

Practical tests have been carried out by shooting as well as fall shocks. The tests show that the invention is practically realizable. As to the structure of the charge it is dependent of the particle size of the oxygen donating component as well as of the fuel particles, their specific weight and their sliding ability. Which of the two components is to be arranged outermost depends on the relative proportion between these parameters for the two components. The charge structure must further take into consideration the special properties of the projectile, its acceleration, rotation, and retardation as well as the minimum distance to the target etc.

If the properties of the projectile are of such a kind that it is difficult to obtain a complete mixture after the firing, one can premix the two components 2 and 3 somewhat on beforehand, i.e., before filling of the nose hood. The outer layer thus can consist of, for instance, 95% oxygen donating component and 5% fuel while the inner layer can consist of 95% fuel and 5% oxygen donating component. The component mixing will then more easily take place without substantial drawbacks as to safety.

Figure 2:
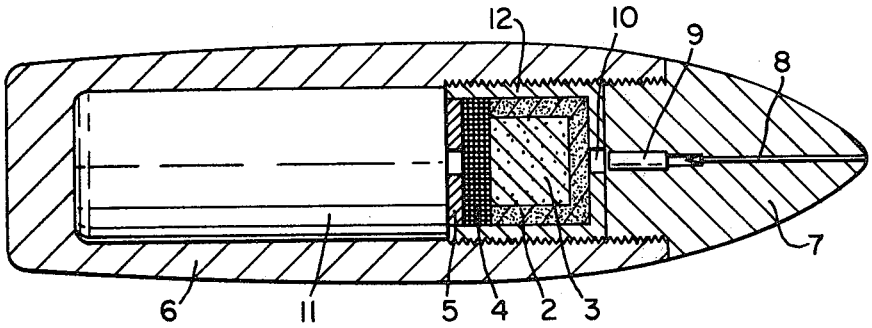
FIG. 2 is a cross sectional view of a second embodiment of the invention.

If desired the device according to the invention can also be used behind the foremost ignition charge or behind a detonator charge which is ignited by a striker rod or other ignition device. In FIG. 2 a structure is shown which provides such effect. The projectile body 6, which can contain a bursting, incendiary, or bursting-/incendiary charge 11, has a nose or nose piece 7 containing a central striker rod 8. At the impingement of the projectile on a target this rod will strike a detonator 9 the column of fire or spark of which passes through a hole 10 into a charge box 12 or the like, which is secured in the foremost end of the projectile, for instance by means of threads. The box 12 contains a ignition transfer means and safety arrangement similar to that described in connection with FIG. 1. If the detonator in the nose of the projectile inadvertantly should be ignited, the effect thereof will reach the fuel. Due to lack of oxygen the fuel will, however, not be ignited and the burning will cease. During the firing and the rotation of the projectile, the charge 2 and the charge 3 are mixed in the same way as described above. When the detonator is ignited by hitting a target the resultant effect will therefore be transferred or relayed into a very sensitive mass which will be ignited. The explosive combustion of the mixture 2 and 3 thereby will result in that the bursting charge 4 explodes. This charge will then cause the rear charge 11 in the projectile to explode, which charge can be the main charge of the projectile.

The bursting charge, of course, also can be a premixed incendiary charge and the disc 5 can then be provided with a hole for further ignition transfer.

The same factors such as the particle size, the specific weight of the batch etc. will then have to be taken into account. Further, the special properties of the projectile will have to be taken into consideration. In this case one must consider the effect of the detonator, in case also the ignition charge.

It is of course possible to use the invention for other arrangements in addition to the above mentioned, but having the same aim; namely to establish a safety region behind the ignition charge or the detonator and to transfer and amplify, i.e., relay and boost, the ignition impulse after firing.

Figure 3:
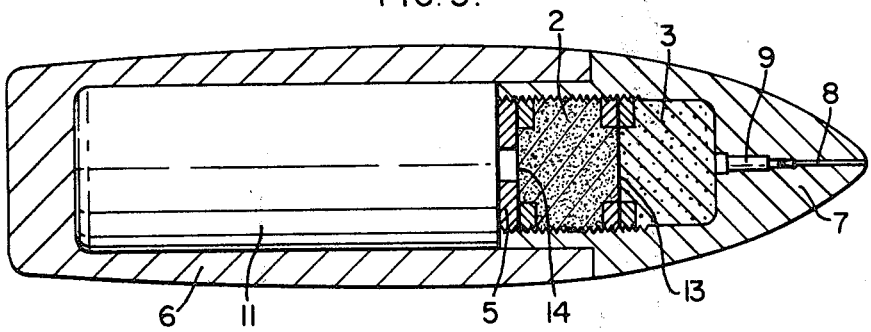
FIG. 3 is a cross sectional view of a third embodiment of the invention.

In FIG. 3 there is shown a further embodiment of the projectile in which the invention is incorporated again, the elements corresponding to those in the previous embodiments are given the same reference numerals.

Thus 6 denotes the projectile body which is provided with a nose piece 7. In the rear part of this is a cavity in which the ignition transfer and safety means are arranged. In the nose piece a detonator 9 and a striker rod 8 are provided.

In this case the two components forming the ignition charge are arranged one behind the other, the oxygen donating component 2 laying loosely behind the fuel 3 which also is in loose condition. The two components are separated by a foil or thin plate 13. This foil 13 is so adapted that it cracks responsive to the firing acceleration. Behind the oxygen donating material 2 it is further arranged a foil or thin plate 14 which forms rearward sealing and which is more solid so that it does not break responsive to the firing acceleration.

The function of the projectile according to FIG. 3 is as follows:

Upon firing the foil 13 breaks and the fuel 3 comes into engagement with the oxygen donating material 2. By the rotation of the projectile the two components are then mixed together and when the target is hit and the detonator 9 explodes, the charges 2 and 3 are mixed together is a very heat sensitive batch which will take up, amplify and transfer the ignition pulse rearwardly in the projectile. The foil 14 is in this case, as mentioned above, so adapted that it does not break during the firing. However, foil 14 is not so strong that it does not burst when the charge 2 and 3 are ignited and the pressure is built up in the front of the foil. Before firing, the projectile cannot be ignited due to unintended ignition of the detonator because the charge 3 consists only of fuel and cannot burn due to lack of oxygen.

It shall be pointed out that the purpose of three above described embodiments which are illustrated schematically in the drawing is only to illustrate the inventive idea and that this idea can be modified in many ways within the scope of the invention as defined in the claims. Thus it would be feasible to use a charge consisting of more than two components. An additional component may further consist of neutral particles which have for its object to hasten the mixing of the two main components. These particles can for instance have a form and/or specific weight which differs from the main component particles. It is also possible to give the main component particles a different form and/or size, thereby to hasten the mixing.

I claim:

1. A safety device for a projectile comprising a charge which is adapted to function either as an ignition charge or as a booster and relay charge, wherein the improvement comprises a charge comprising at least two components each of which comprises solid particles, said solid particles comprising said two components being disposed in the same cavity in the projectile, said components being at least partly separated and being arranged in relation to each other such that said components will be mixed subsequent to the firing of the projectile responsive to the acceleration, rotation and retardation forces to which the components are subjected after the projectile is fired.

2. A safety device according to claim 1, wherein said charge is placed in a central cavity in the projectile, and said charge comprises an oxygen donating component and a fuel component.

3. A safety device according to claim 2, wherein said projectile includes a nose and said cavity is arranged in said nose of the projectile.

4. A safety device according to claim 1 wherein said projectile comprises a body portion and a nose portion, said cavity is provided by a box-like body secured in the foremost part of the body portion of the projectile and arranged to house the said charge, and a detonator being provided in the nose portion of said projectile together with ignition means for said detonator.

5. A safety device according to claim 1, wherein the two charge components are arranged in a cavity and are separated in said cavity by a thin foil, said thin foil extending normal to the longitudinal axis of the projectile and being such as to be broken by the acceleration of the projectile caused by firing.

6. A safety device according to claim 1, wherein the particles of the two components are of different forms and sizes.

7. A safety device according to claim 1, wherein the charge comprises more than two components, at least one of the components in addition to said two serving to promote mixing of the said two components.

* * * * *